US007281736B2

(12) United States Patent
Sannah et al.

(10) Patent No.: US 7,281,736 B2
(45) Date of Patent: Oct. 16, 2007

(54) POTHOLE PROTECTION MECHANISM

(75) Inventors: Muhammad Sannah, Greencastle, PA (US); Joan LaSalle, Breezewood, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 520 days.

(21) Appl. No.: 10/751,540

(22) Filed: Jan. 6, 2004

(65) Prior Publication Data

US 2005/0224290 A1 Oct. 13, 2005

(51) Int. Cl.
*B66B 5/00* (2006.01)
*E06C 1/00* (2006.01)

(52) U.S. Cl. ..... 280/755; 280/763.1; 280/764.1; 182/69.6; 182/63.1; 182/141; 187/243

(58) Field of Classification Search ..... 280/755, 280/763.1, 764.1; 187/243; 212/302, 305; 182/69.5, 69.6, 63.1, 141
See application file for complete search history.

(56) References Cited

U.S. PATENT DOCUMENTS 4,175,644 A * 11/1979 Sikli ..... 187/269
5,890,737 A 4/1999 Hutka
6,425,459 B1 7/2002 Keefer
6,561,546 B2 * 5/2003 Puszkiewicz et al. ..... 280/755

FOREIGN PATENT DOCUMENTS

| | | |
|---|---|---|
| DE | 295 02 398.8 | 6/1995 |
| DE | 201 16 122 | 2/2002 |
| FR | 2 548 996 | 1/1985 |
| JP | 5-262209 | 10/1993 |

* cited by examiner

*Primary Examiner*—Paul N. Dickson
*Assistant Examiner*—George D. Spisich
(74) *Attorney, Agent, or Firm*—Nixon & Vanderhye P.C.

(57) ABSTRACT

A pothole protection mechanism provides additional support for the vehicle in the event a wheel is driven into a hole while the platform is elevated. The mechanism includes an extendible and retractable pothole protection bar. A mechanism serves to actuate the pothole protection mechanism based on a position of the vehicle lifting section. The construction of the mechanism serves to prevent a crushing hazard while deploying the bar and tolerates fixed objects on the ground while raising the bar.

14 Claims, 3 Drawing Sheets

POTHOLE PROTECTION MECHANISM

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

The present invention relates to a pothole protection mechanism for a vehicle including an aerial work platform (AWP).

Self-propelled AWPs such as scissor lifts are typically equipped with an apparatus that provides additional support for the lift in the event that a wheel is driven into a hole. Such an apparatus works normally by reducing the ground clearance to less than one inch when the platform of the AWP is elevated beyond a certain height.

One way of achieving this is by means of a bar or a plate that is attached to the chassis of the AWP and can be lowered down and locked in position when the platform is elevated. Subsequently, the bar or plate can be raised up when the platform is lowered.

The mechanism that performs the lowering, locking and raising tasks is referred to as a pothole protection mechanism. Important requirements of the pothole protection mechanism are to avoid any crushing hazard while deploying the bar and to be able to tolerate fixed objects on the ground while raising the bar.

Current designs are typically based on one of two concepts. A typical six-bar mechanism and a spring are provided to ensure the locking position. This design, however, suffers from excessive numbers of parts and consequently from cost and reliability. A typical four-bar mechanism incorporates a linear actuator linking two of its links. The actuator is either hydraulic or electrical. Drawbacks of this design, however, include reliability, and potential leakage of hydraulic fluid.

BRIEF SUMMARY OF THE INVENTION

It would be desirable to provide a simpler five-bar mechanism that performs all the required tasks for a pothole protection mechanism while maintaining reliable and efficient operation. The pothole protection mechanism of the invention includes an actuator that is connected to the lifting platform of the vehicle to drive the mechanism. The actuator includes a spring that is constrained to compress or extend along a pin. With this construction, the pothole protection mechanism of the invention allows for manufacturing tolerances, and allows the lowering of the lifting object with the pothole protection bar hung-up against an object fixed to the ground. Moreover, being part of the lifting object (e.g., scissor arms) rather than the chassis enables the mechanism to be tolerant to debris accumulation.

In an exemplary embodiment of the invention, a pothole protection mechanism is provided for a lift vehicle including a lifting section supported on a vehicle frame. The pothole protection mechanism includes an actuator attached to the lifting section of the lift vehicle, which actuator is displaced between an extended position and a retracted position based on a position of the lifting section. A crank including an engagement member at an upper end is positioned to be engaged by the actuator. The crank includes a slot between the upper end and a lower end. A connector secured to the vehicle frame and engaged with the crank through the slot movably secures the crank to the frame. A coupler link is pivotally secured at a first end to the lower end of the crank, and a pothole protection bar is pivotally secured to a second end of the coupler link and pivotally secured to the vehicle frame.

The pothole protection bar may be pivoted between a use position and a stowed position based on the position of the lifting section. The actuator may include a plate member slidably mounted on a pin rigidly secured to the frame, and a spring mounted on the pin between the frame and the plate member. In this context, a spring constant of the spring is preferably about 470 lb/in.

The connector may be structurally configured only for translation in the slot, where the slot is preferably at a predetermined angle with respect to a longitudinal axis of the crank. Additionally, the slot may be offset with respect to the longitudinal axis of the crank. The connector may alternatively be structurally configured only for translation and rotation in the slot.

The pothole protection bar is preferably pivoted through an arc substantially limited to 90° between the use position and the stowed position.

The mechanism may additionally include a frame pin coupled to the vehicle frame, serving as a stop for the crank.

In another exemplary embodiment of the invention, a lift vehicle incorporates the pothole protection mechanism of the invention. The lifting section may be a scissors lift.

In yet another exemplary embodiment of the invention, a pothole protection mechanism is provided for a lift vehicle including a lifting section supported on a vehicle frame. The pothole protection mechanism includes an actuator attached to the lifting section of the lift vehicle, where the actuator is displaced between an extended position and a retracted position based on a position of the lifting section. A crank including an engagement member at an upper end is positioned to be engaged by the actuator, which crank further includes a slot between the upper end and a lower end, wherein a connector secured to the vehicle frame is movably secured in the slot. A coupler link is pivotally secured at a first end to the lower end of the crank, and a pothole protection bar is pivotally secured to a second end of the coupler link and pivotally secured to the vehicle frame.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
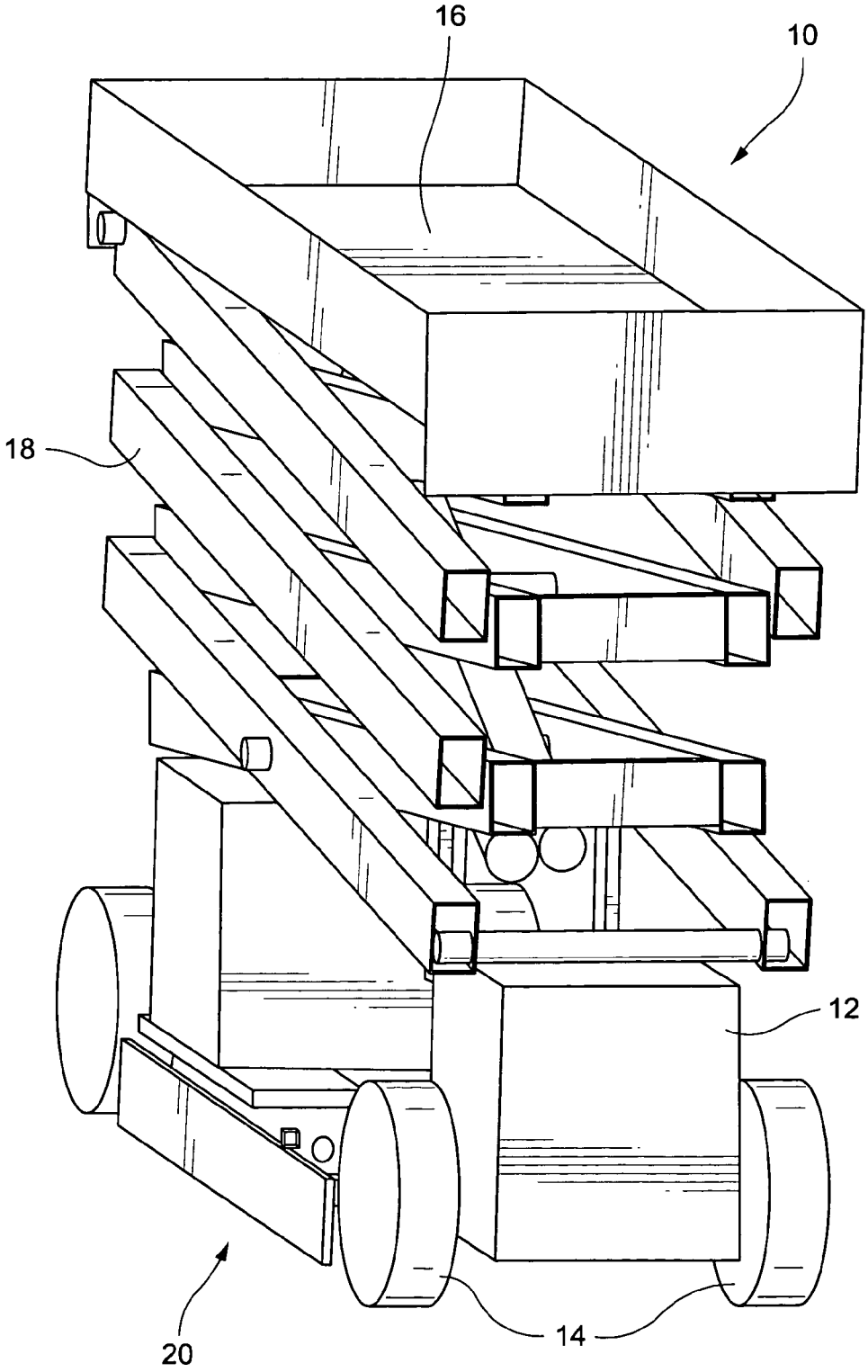
FIG. 1 is an exemplary perspective view of a scissor lift incorporating the pothole protection mechanism of the present invention.

FIG. 1 is a perspective view of a scissor lift 10, which is exemplary for an aerial work platform vehicle suitable for the pothole protection mechanism of the present invention. The lift vehicle 10 generally includes a vehicle frame or chassis 12 on which a plurality of wheels 14 are mounted.

The wheels 14 are typically driven by a suitable driving mechanism via controls positioned in the vicinity of a vehicle platform 16. The vehicle platform 16 is raised and lowered by a lifting section 18, shown as a scissor lift in FIG. 1, which lifting section 18 is supported on the vehicle frame 12. A pothole protection mechanism 20 is secured to the frame 12 generally within a perimeter defined by the vehicle wheels 14. The mechanism 20 is described with respect to one side only. Those of ordinary skill in the art will appreciate that the other side is a mirror copy.

As noted above, the pothole protection mechanism 20 serves to reduce the ground clearance typically to less than one inch when the platform 16 is elevated beyond a certain height. In this manner, the pothole protection mechanism 20 provides additional support for the vehicle 10 in the event when a wheel is driven into a while the platform 16 is elevated.

Figure 2:
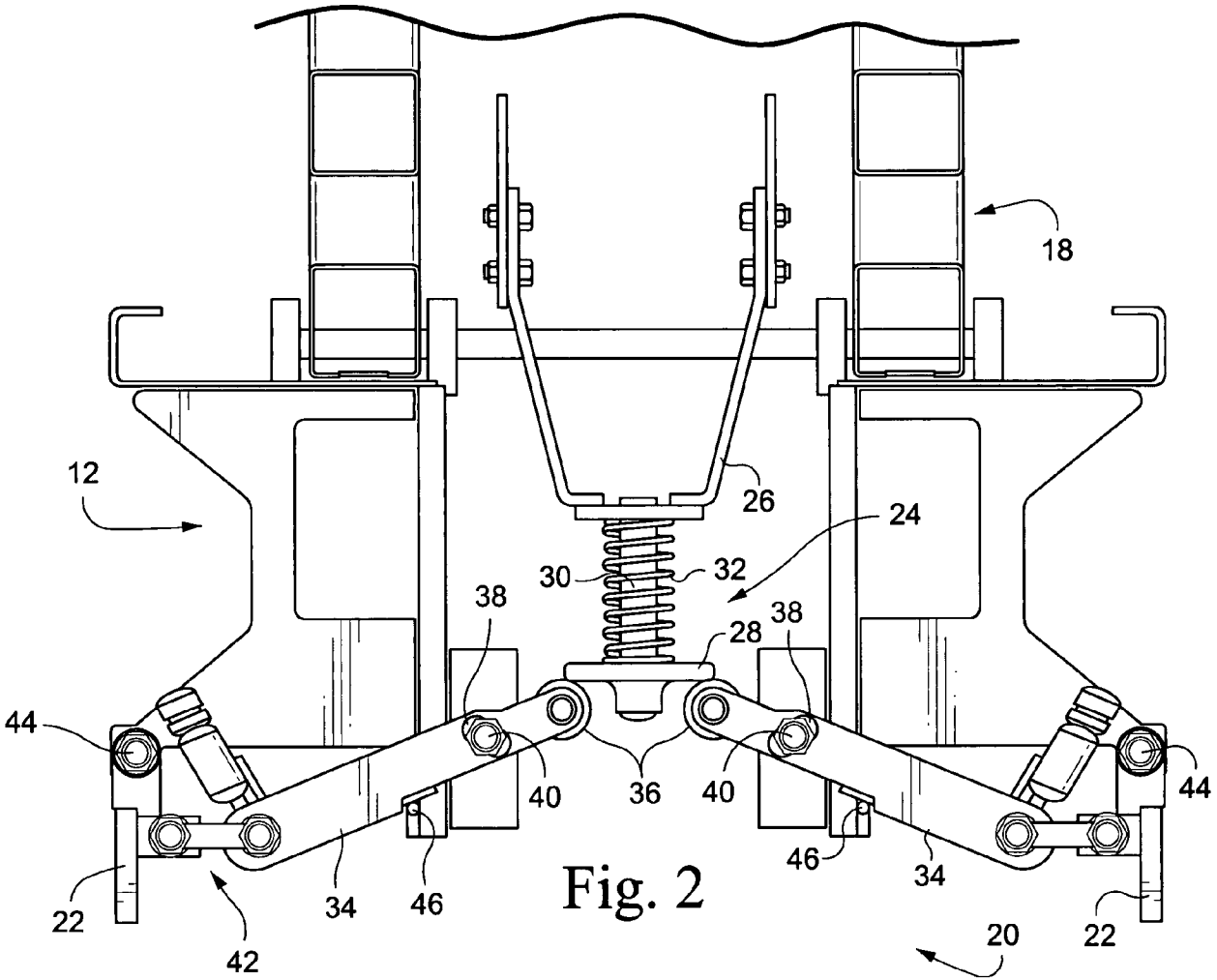
FIG. 2 illustrates the pothole protection mechanism pivoted to a use position.
Figure 3:
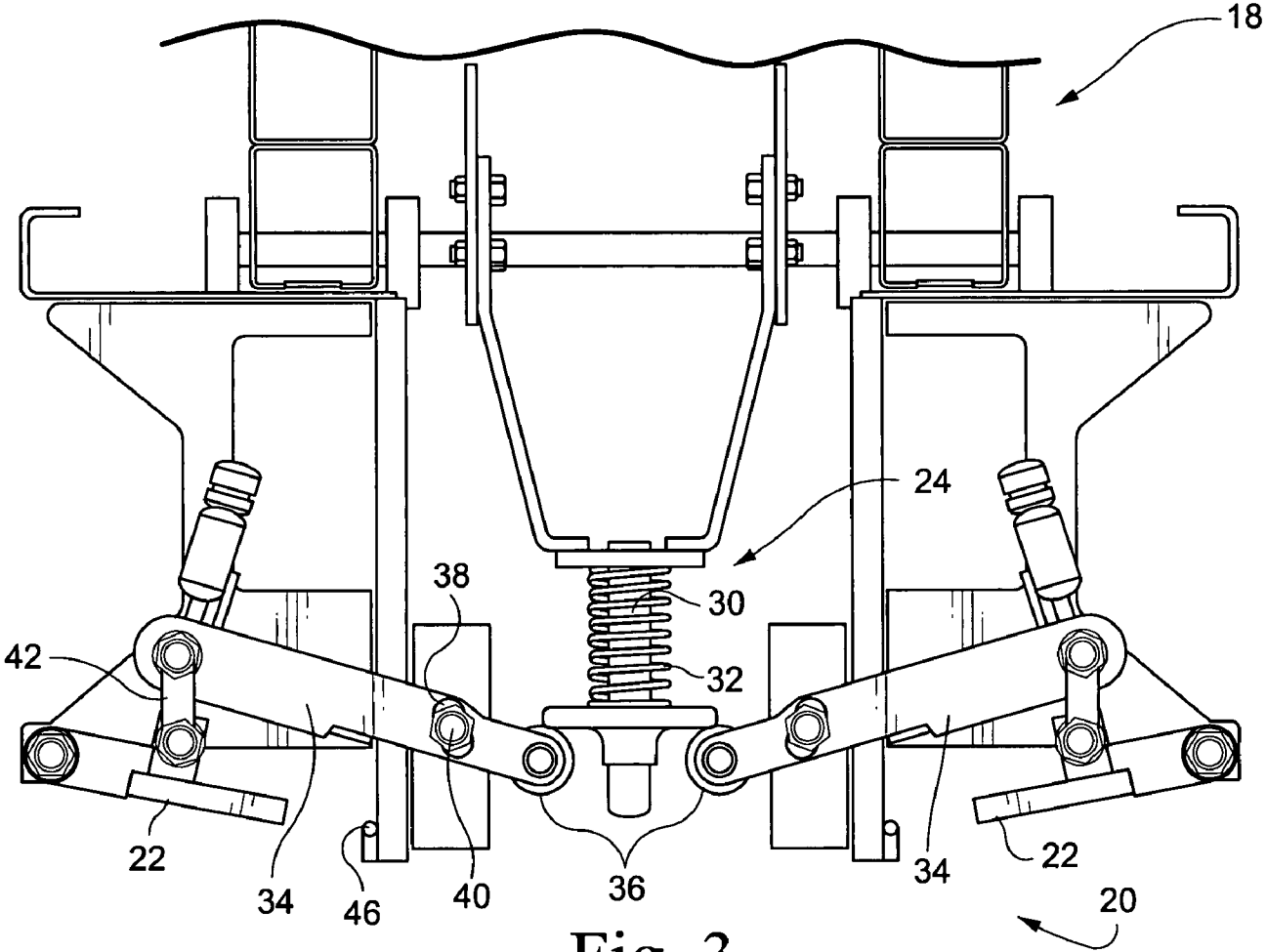
FIG. 3 illustrates the pothole protection mechanism pivoted to a stowed position.

FIGS. 2 and 3 illustrate the details of the pothole protection mechanism 20 of the present invention. The pothole protection mechanism 20 includes a pothole protection bar 22 disposed generally between each of the left and right side wheels 14, respectively. In FIG. 2, the pothole protection bar 22 is shown in a use position, while FIG. 3 illustrates the pothole protection bar 22 in a stowed position. An advantage of the present invention is that the pothole protection bar 22 is pivoted between the use position and the stowed position without the use of a powered actuator. Rather, a non-powered actuator 24 is coupled directly with the lifting section 18 (such as scissor arms) of the lift vehicle.

The actuator 24 is secured to the lifting section 18 of the lift vehicle via a connector frame 26 by any suitable connection means. As such, the actuator 24 is displaced between a retracted position (FIG. 2) and an extended position (FIG. 3) based on a position of the lifting section 18. The actuator 24 is constructed of a plate member 28 slidably mounted on a pin 30. A spring 32 is mounted on the pin 30 between the plate member 28 and the connector frame 26. The actuator 24 via plate 28 engages a pair of cranks 34, one for each pothole protection bar 22, the cranks 34 including rollers 36 at ends thereof to facilitate engagement. Each crank 34 includes a slot 38 therein between an upper end and a lower end of the crank 34 and is engaged to a connector 40, which is pivoted to the vehicle frame 12. The crank is movably secured through its translation joint with the connector 40. Alternatively, the connection assembly 38, 40 can be comprised of a half-joint enabling the crank 34 to both translate and rotate with respect to a pin fixed to the frame. The orientation of the slot 38, disposed at a predetermined angle with respect to a longitudinal axis of the crank 34, is designed to allow the crank 34 and coupler link 40 to rotate through a straight-line (i.e., collinear) configuration and to secure locking of the mechanism in the deployed position The slot 38 orientation offset with respect to the longitudinal axis of the crank 34 enables the configuration to assume a locked position.

A coupler link 42 is pivotally secured at a first end to a lower end of the crank 34. The pothole protection bar 22 is pivotally secured to a second end of the coupler link 42 and pivotally secured to the vehicle frame 12 at a pivot 44.

The described components, including the vehicle frame 12, the crank 34, the connector 40, the coupler link 42 and the pothole protection bar 22 define a five-bar mechanism to effect actuation of the pothole protection mechanism. When the connector 40 is constructed utilizing a half-joint, enabling translation and rotation of the crank with respect to the chassis 12, the arrangement is deemed a modified five-bar mechanism. Generally, the half joint (pin in a slot) is the preferred choice for the present application; although for other applications with higher loads, a pinned or pivoted slider would be a preferred design.

The pothole protection bar 22, is permitted to rotate a maximum of substantially 90° toward the chassis 12 center. No rotation is permitted in the opposite direction.

The construction of the actuator 24 including the plate 28, pin 30 and spring 32 coupled through the connector frame 26 to the lifting section 18 of the vehicle effects important advantages of the invention, allowing for manufacturing tolerances and additionally enables lowering of the lifting object even with the pothole protection bar 22 hung-up against an object fixed to the ground. That is, if tolerance stack up makes the pothole protection bar 22 reach the limit of its rotation for the stowed position with less than the nominal rotation of the crank 34, the spring compliance would allow for that without causing any damage to the mechanism components. Additionally, since the actuator forms part of the lifting section 18 rather than the chassis 12, the device is more tolerant to debris accumulation. That is, if the plunger is attached to the chassis 12, debris might get into the spring coil 32 preventing it from working properly.

Deployment and retraction of the pothole protection mechanism will be described with continued reference to FIGS. 2 and 3. FIG. 3 shows the actuator 24 in its extended position with the pothole protection bar 22 pivoted to its stowed position. The pothole protection bar 22 is stowed when the lifting mechanism is in a lowered position. When the lifting section 18 starts to move up in order to lift the platform 16, the actuator 24 moves with the lifting section 18 away from the rollers 36 of the cranks 34. This action serves to release the load that keeps the mechanism in its raised or stowed position. Simultaneously, under the effect of gravity, the pothole protection bar 22 starts to pivot about pivot 44 toward its use position. The crank 34 and coupler link 42 go through straight-line configuration and end up with the coupler link 42 near horizontal and the crank 34 jammed against a stop or frame pin 46 on the frame 12. Due to its weight and constrained movement from the frame pin 46, the crank 34 rotates counterclockwise around its pivot with the coupler link 42 until it makes contact with the connector 40 at the opposite end of the slot 38.

In the use position, the pothole protection bar 22 is locked in place, and the only way to displace the pothole protection bar 22 out of this position is to push downward on the crank 34 at or near the roller 36. In other words, any force in any direction on the pothole protection bar 22 will not lead to movement out of the locked use position.

The process of retracting the pothole protection bar 22 to its stowed position is exactly opposite to the process of deploying it. When the lifting section 18 approaches its retracted position, the actuator 24 makes contact with the rollers 36, gradually pushing them downward, which in turn forces the cranks 34 to slide along the slot 38. As the actuator 24 continues to push down, the cranks 34 pivot around the slot and connector arrangement 38, 40 and rotates upward lifting with it the pothole protection bar 22 to its stowed position.

The stiffness of the actuator spring 32 is designed to prevent movement of the pothole protection bar 22 during transportation. Additionally, the spring 32 is compliant enough to allow for lowering the lifting mechanism 18 when the pothole protection bar 22 is hung-up against an object fixed to the ground. The spring constant of the spring 32 is generally a function of the weight of the lifting mechanism 18 as well as the force required to displace the pothole protection bar 22. In one preferred configuration, the spring constant is about 470 lb/in.

With the pothole protection mechanism of the present invention, a simplified construction facilitates operation, reduces construction costs and reduces maintenance. Additionally, due to the fact that the mechanism locks right after the pothole protection bar is fully lowered to its use position, it prevents crushing hazards, and the use of a spring-loaded actuator enables the mechanism to tolerate fixed objects on the ground while raising the bar.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A pothole protection mechanism for a lift vehicle including a lifting section supported on a vehicle frame, the pothole protection mechanism comprising:

an actuator attached to the lifting section of the lift vehicle, the actuator being displaced between an extended position and a retracted position based on a position of the lifting section;

a crank including an engagement member at an upper end positioned to be engaged by the actuator, the crank farther including a slot between the upper end and a lower end, wherein a connector secured to the vehicle frame and engaged with the crank through the slot movably secures the crank to the vehicle frame;

a coupler link pivotally secured at a first end to the lower end of the crank; and a pothole protection bar pivotally secured to a second end of the coupler link and pivotally secured to the vehicle frame, wherein the pothole protection bar is pivotable between a stowed position and a use position based on the position of the lifting section.

2. A pothole protection mechanism according to claim 1, wherein the actuator comprises:

a plate member slidably mounted on a pin rigidly secured to the frame; and a spring mounted on the pin between the frame and the plate member.

3. A pothole protection mechanism according to claim 2, wherein a spring constant of the spring is about 470 lb/in.

4. A pothole protection mechanism according to claim 1, wherein the connector is structurally configured to allow only for translation of the crank with respect to the connector.

5. A pothole protection mechanism according to claim 4, wherein the slot is at a predetermined angle with respect to a longitudinal axis of the crank.

6. A pothole protection mechanism according to claim 5, wherein the slot is offset with respect to the longitudinal axis of the crank.

7. A pothole protection mechanism according to claim 1, wherein the connector is structurally configured only for translation and rotation of the crank with respect to the connector.

8. A pothole protection mechanism according to claim 1, wherein the pothole protection bar is pivoted through an arc substantially limited to 90° between the use position and the stowed position.

9. A lift vehicle according to claim 8, wherein the lifting section comprises a scissors lift.

10. A pothole protection mechanism according to claim 1, further comprising a frame pin coupled to the vehicle frame, the frame pin serving as a stop for the crank.

11. A lift vehicle comprising:

a vehicle frame;

a lifting section supported on the vehicle frame; and a pothole protection mechanism, the pothole protection mechanism comprising:

an actuator attached to the lifting section of the lift vehicle, the actuator being displaced between an extended position and a retracted position based on a position of the lifting section, a crank including an engagement member at an upper end positioned to be engaged by the actuator, the crank farther including a slot between the upper end and a lower end, wherein a connector secured to the vehicle frame and engaged with the crank through the slot movably secures the crank to the vehicle frame, a coupler link pivotally secured at a first end to the lower end of the crank, and a pothole protection bar pivotally secured to a second end of the coupler link and pivotally secured to the vehicle frame, wherein the pothole protection bar is pivotable between a stowed position and a use position based on the position of the lifting section.

12. A lift vehicle according to claim 11, wherein the actuator comprises:

a plate member slidably mounted on a pin rigidly secured to the frame; and a spring mounted on the pin between the frame and the plate member.

13. A lift vehicle according to claim 12, wherein a spring constant of the spring is about 470 lb/in.

14. A pothole protection mechanism for a lift vehicle including a lifting section supported on a vehicle frame, the pothole protection mechanism comprising:

an actuator attached to the lifting section of the lift vehicle, the actuator being displaced between an extended position and a retracted position based on a position of the lifting section;

a crank including an engagement member at an upper end positioned to be engaged by the actuator, the crank farther including a slot between the upper end and a lower end, wherein a connector secured to the vehicle frame and engaged with the crank through the slot movably secures the crank to the vehicle frame;

a coupler link pivotally secured at a first end to the lower end of the crank; and a pothole protection bar pivotally secured to a second end of the coupler link and pivotally secured to the vehicle frame.

* * * * *